United States Patent [19]

Rains et al.

[11] 4,324,422

[45] Apr. 13, 1982

[54] LOW TORQUE PACK-OFF SEAL ASSEMBLY WITH RETRIEVABLE LOWER SECTION

[75] Inventors: John K. Rains, Ventura; Larry E. Reimert, Thousand Oaks, both of Calif.

[73] Assignee: Vetco Offshore, Inc., Ventura, Calif.

[21] Appl. No.: 125,301

[22] Filed: Feb. 27, 1980

[51] Int. Cl.[3] ..... E21B 33/04

[52] U.S. Cl. ..... 285/140; 166/87; 166/88; 277/9.5

[58] Field of Search ..... 285/139, 140, 338, 351; 166/87, 88; 277/9.5

[56] References Cited

U.S. PATENT DOCUMENTS

| | | | |
|---|---|---|---|
| 1,777,564 | 10/1930 | Hosmer | 285/139 X |
| 1,811,013 | 6/1931 | Humason | 166/88 |
| 2,447,546 | 8/1948 | Spencer | 285/140 X |
| 2,504,025 | 4/1950 | Humason | 166/88 X |
| 2,878,876 | 3/1959 | Long | 277/9.5 |
| 3,797,864 | 3/1974 | Hynes et al. | 285/140 |
| 4,131,287 | 12/1978 | Gunderson et al. | 277/9.5 X |

*Primary Examiner*—Thomas F. Callaghan
*Attorney, Agent, or Firm*—Arthur E. Fournier, Jr.

[57] ABSTRACT

A pack-off seal assembly 26 particularly suitable for use for purposes of effecting a seal between a wellhead housing 18 and a casing hanger 16. The subject pack-off seal assembly 26 is designed to be interposed between the cylindrical wall surface 18*a* of the wellhead housing 18 and that of a casing hanger 16 so as to be movable between a non-sealing position and a sealing position relative thereto in response to an actuating force of low torque magnitude being applied thereto. The pack-off sealing assembly 26 includes an upper metal seal 30 having downwardly extending lips 44, a lower metal seal 32 having upwardly extending lips 46, and a plurality of independent non-bonded elastomeric members 36, 38 of differing diameters suitably supported between the upper and lower metal seals 30, 32. In addition, the upper and lower metal seals 30, 32 are provided with first and second means, respectively, that are designed to be operative to insure the retrievability of the lower metal seal 32 from between the wellhead housing 18 and the casing hanger 16 should removal of the pack-off seal assembly 26 be necessitated. The latter first and second means are cooperatively associated one with another so as to be operable to establish a lost motion connection between the upper metal seal 30 and the lower metal seal 32 when the pack-off seal assembly 26 is moved in a first direction between the non-sealing and sealing positions thereof, and so as to be operable to establish a rigid connection between the upper metal seal 30 and the lower metal seal 32 when the pack-off seal assembly 26 is moved in a second direction between the non-sealing and sealing positions thereof.

8 Claims, 5 Drawing Figures

LOW TORQUE PACK-OFF SEAL ASSEMBLY WITH RETRIEVABLE LOWER SECTION

BACKGROUND OF THE INVENTION

This invention relates to the structure employed in the wellhead portion of a subsea drilling system and, more particularly, to a seal assembly operable for use in a conventional wellhead/casing hanger system to effect a sealing of the annular opening formed between the wellhead housing and a casing hanger by virtue of the spacing that exists between the inner wall surface of the former and the outer wall surface of the latter.

In accord with the teachings of the prior art, it is known to construct a subsea drilling system by means of the interconnection of a plurality of mutually cooperative subsystems. Moreover, by way of illustration in this regard, it has been known heretofore to effect the construction of a subsea drilling system by interconnecting together three subsystems; namely, a marine riser system, a well control system and a wellhead system. In accord with the nature of this form of construction, the three named subsystems are suitably interconnected such that the marine riser system extends from essentially the surface of the sea to a point therebelow, the wellhead system is suitably positioned on the sea bottom, and the well control system is interposed in interconnected relation between the marine riser system and the wellhead system.

In a word, the function of each of the three above-named subsystems in a subsea drilling system is in substance as follows. The marine riser system is basically intended to perform three functions. Namely, it serves as a conduit for the return of drilling fluids, it operates as a guide for drilling tools and casing strings, and it is employed to run and install the blowout preventer stack. The well control system, otherwise known as the blowout preventer stack, provides the means to control sudden changes in well bore pressures during drilling operations. Finally, the wellhead system functions as a pressure vessel to which casing strings are securely sealed in the course of the performance of the drilling operation.

In further regard to the wellhead system, the latter is sometimes also referred to as a wellhead/casing hanger system. Typically, such a system is comprised of at least a wellhead housing and a casing hanger, with the latter designed to be positioned within the former. When the casing hanger is so positioned relative to the wellhead housing, an annular opening is formed therebetween. More specifically, this annular opening represents the spacing, i.e., the clearance, that necessarily exists between the inner wall surface of the wellhead housing and the outer wall surface of the casing hanger. The desirability of packing off this annular opening, i.e., effecting a sealing thereof, as well as the reasons therefor are well known to those skilled in this art, and, accordingly, it is not deemed necessary to iterate them herein.

The matter of effecting the packing off of the aforereferenced annular opening that is present between the wellhead housing and the casing hanger has been addressed in the prior art. More specifically, as taught, for example, in U.S. Pat. No. 3,797,864—Hynes, et al., which is assigned to the same assignee as the present invention, it is known to interpose an elastomeric seal device between the wellhead housing and the casing hanger to effect a packing off, i.e., a sealing of the clearance existing therebetween. In accord with the teachings of this patent, the subject elastomeric seal device includes an upper metal seal having downwardly extending lips projecting therefrom, a lower metal seal having upwardly extending lips projecting therefrom, and an elastomeric seal ring supported between the aforementioned upper and lower metal seals. The mode of operation of this elastomeric seal device is such that in response to a force being applied thereto metal-to-metal contact is established between the lips of the metal seals and the corresponding wall surfaces of the wellhead housing and the casing hanger. In addition, a deformation of the elastomeric seal ring is effected such that the latter is also forced into engagement with the wall surfaces of both the wellhead housing and the casing hanger.

Although from an operational standpoint, the elastomeric seal device constructed in accordance with the teachings of the Hynes, et al. patent has performed satisfactorily, improvements in the construction thereof are still to be desired. Namely, it has been found that, in order to energize the seal with the aforedescribed elastomeric seal device to pack-off the annular clearance between the wellhead housing located underwater and the respective casing hangers located in this housing, commonly has required the application to the seal device of a torque force on the order of 20,000 ft.-lbs. More specifically, it has taken the application of a torque force of this magnitude in order to effect the seal desired, i.e., a 10,000 psi seal, when an elastomeric seal device constructed in accordance with the teachings of the Hynes, et al. patent is employed.

Inasmuch as the elastomeric seal device, which has been described above, is commonly employed at a substantial distance below the surface of a body of water, it is necessary that means be provided for transmitting a torque force of the requisite magnitude through a considerable distance before it can be applied to accomplish the energization of the subject seal device. Accordingly, it would be viewed as a favorable attribute of any seal device employable in the wellhead portion of a subsea drilling system, if it were possible, through the use thereof, to realize a measurable reduction in the magnitude of the torque force required to effect a seal of a given pressure from that needed when utilizing other forms of the same functional type of seal device to achieve a seal of the same pressure. Moreover, the ability to accomplish the energization of a seal device of the subject type with a reduced amount of torque force becomes even more important as the distances at which it is desired to conduct subsea drilling operations continue to increase. Namely, the feasibility of transmitting a torque force of a given magnitude decreases as the distance, through which the torque force is required to be transmitted before the application thereof, increases. The reasons for this are many and varied, but are well known to those skilled in the art of subsea drilling systems. Accordingly, it is not deemed necessary to state them at this point.

Once having been emplaced in sealing relation relative to a wellhead housing and a casing hanger, it is normally intended that the elastomeric seal device constructed as described above will remain so positioned. However, on occasion, the need arises to effect the removal of this elastomeric seal device from between the wellhead housing and the casing hanger. The elastomeric seal device, which forms the subject matter of the afore-referenced Hynes, et al. patent, has, unfortunately, proven to be disadvantageously characterized insofar as concerns effecting the removal thereof from the wellhead portion of a subsea drilling system. Namely, once having been energized, as referred to previously hereinabove, such that metal-to-metal contact is established between the lips of the metal seals and the wall surfaces of the wellhead housing and the casing hanger, and such that the elastomeric seal ring has undergone deformation so as to be in engagement with the same wall surfaces of the wellhead housing and the casing hanger, difficulties have been encountered in some instances in effecting the removal of the elastomeric seal ring from between the wellhead housing and the casing hanger. More specifically, the nature of the difficulty, which has been encountered in this regard, resides in the fact that the elastomeric seal ring has evidenced a susceptibility to sever when force is applied to the upper metal seal in an effort to remove the elastomeric seal device from its sealing position. That is, a severing of the elastomeric seal ring has occurred whereby the lower metal seal remains emplaced in the position which the latter has occupied for purposes of effecting the packing off of the clearance opening between the wellhead housing and the casing hanger. A need has thus been evidenced in the prior art for a seal device that would be capable of being removed from between a wellhead housing and a casing hanger when the need for such removal arises, without concomitantly being disadvantageously characterized, as is the Hynes, et al. elastomeric seal device, by the tendency of the elastomeric seal ring to sever leaving the lower metal seal still emplaced.

In summary, there has been shown to exist in the prior art a need for a new and improved seal device capable of being employed in a subsea drilling system and operable therein for purposes of effecting the packing off of the annular clearance between the underwater wellhead housing and the respective casing hangers, which are landed in the housing. Moreover, a need has been shown for such a device, which would be characterized by the fact that it is capable of being employed in the manner of the Hynes, et al. elastomeric seal device previously referred to hereinabove, while at the same time being advantageously characterized relative thereto in the fact that the new and improved seal device is capable of being energized with a torque force of lesser magnitude than the Hynes, et al. elastomeric seal device while retaining the capability of exerting a seal of the same pressure as the Hynes, et al. elastomeric seal device, as well as in the fact that, should the need arise to remove the new and improved seal ring from its sealing position relative to the wellhead housing and the casing hanger, it can be so removed without difficulty, i.e., without fear that portions thereof will be left emplaced between the wellhead housing and the casing hanger.

It is, therefore, an object of the present invention to provide a new and improved form of seal assembly operable for effecting a seal between a pair of spaced surfaces.

It is another object of the present invention to provide such a seal assembly, which is particularly suitable for use in the wellhead portion of a subsea drilling system.

It is still another object of the present invention to provide such a seal assembly that is operable to effect the packing off of the annular clearance between an underwater wellhead housing and the respective casing hangers, which are landed in the housing.

A further object of the present invention is to provide such a seal assembly which is characterized in the fact that it is capable of providing maximum seal integrity over extended periods.

A still further object of the present invention is to provide such a seal assembly which is energizable in response to the application thereto of an energizing force of a significantly lesser magnitude than that required heretofore by prior art forms of seal assemblies that have been employed for similar purposes.

Yet another object of the present invention is to provide such a seal assembly which embodies first and second means that are cooperatively associated one with another so as to be operative to establish a lost motion connection therebetween when the subject seal device is in a state of enegization, and so as to be operable to form a rigid connection therebetween when a need arises to effect the removal of the subject seal device from between a wellhead housing and a casing hanger.

Yet still another object of the present invention is to provice such a seal assembly which is relatively inexpensive to provide and easy to employ, while yet being compatible for use in subsea drilling systems of known construction.

SUMMARY OF THE INVENTION

In accordance with the present invention, there is provided a new and improved pack-off seal assembly particularly suited for employment in a subsea drilling system for purposes of packing off the annular clearance formed in the wellhead portion of such a system, i.e., between the underwater wellhead housing and the respective casing hangers, which are landed in the housing. The subject pack-off seal assembly is movable between a non-sealing position and a sealing position relative to the inner wall surface of the wellhead housing and the outer wall surface of a casing hanger. The pack-off seal assembly includes an upper metal seal having downwardly extending lips, a lower metal seal having upwardly extending lips, and a pair of ordinarily non-bonded elastomeric seal elements of differing diameters. Namely, one of the latter elements has a diameter corresponding to the inner diameter of the annular clearance to be packed off, while the other of the pair of elements has a diameter corresponding to the outer diameter of the subject annular clearance. In addition, the upper metal seal of the pack-off seal assembly is provided with a first means and the lower metal seal of the assembly is provided with a second means. The latter first and second means are operative to insure the retrievability of the lower metal seal from between the wellhead housing and a casing hanger should removal of the pack-off seal assembly be necessitated. The first means comprises a first metallic member formed integrally with the upper metal seal so as to project therefrom in the direction of the major axis thereof, and having a dog-like portion formed at the free end thereof. Similarly, the second means comprises a second metallic member formed integrally with the lower metal seal so as to project therefrom in the direction of the major axis thereof, and having a dog-like portion formed at the free end thereof. The dog-like portions of the first and second metallic members are designed to interlock such that a lost motion connection is established therebetween other than when the pack-off seal assembly is being removed from within the annular clearance that is formed between the wellhead housing and a casing hanger, and such that a rigid connection is established therebetween when the pack-off seal assembly is being removed from the annular clearance.

DESCRIPTION OF A PREFERRED EMBODIMENT

Figure 1:
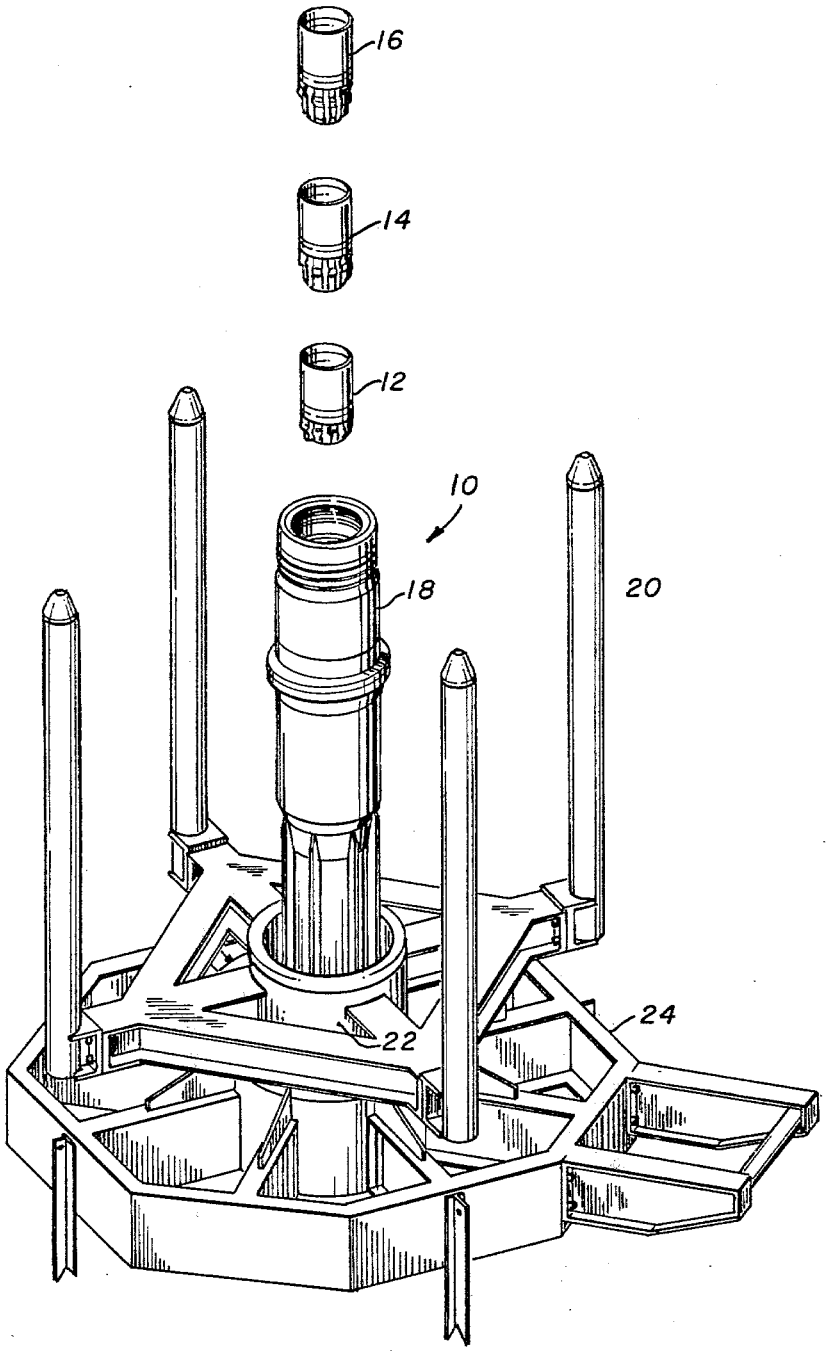
FIG. 1 is an exploded view of a wellhead subsystem of a subsea drilling system that embodies pack-off seal assemblies constructed in accordance with the present invention.

Referring now to the drawing and, more particularly, to FIG. 1 thereof, there is to be found depicted therein one portion of a subsea drilling system; namely, that of the wellhead subsystem, generally designated by reference numeral 10. In this connection, since the subject matter of the present invention is only indirectly related to the overall operation of a subsea drilling system, it is not deemed necessary for purposes of acquiring an understanding of the invention to include a detailed description of the nature of the construction and the mode of operation of an entire subsea drilling system herein, or to illustrate in the drawing the major components thereof other than that of the wellhead subsystem 10 which appears in FIG. 1. Furthermore, since the nature of the construction and the mode of operation of wellhead subsystems of the type depicted in FIG. 1 are known to those skilled in the art to which the present invention relates, i.e., subsea drilling systems, it is likewise deemed unnecessary to include a detailed description of the wellhead subsystem 10 herein. Rather, it is deemed sufficient to merely summarize the nature of the construction and the mode of operation of the wellhead subsystem of FIG. 1 in the manner appearing below. If deemed necessary, however, reference may be had to the prior art for a fuller understanding thereof.

Accordingly, as depicted in FIG. 1 of the drawing, the wellhead subsystem 10 includes a plurality of casing hanger bodies 12, 14 and 16, a multiple hanger high-pressure wellhead housing 18, a permanent guide structure 20 having a wellhead housing 22 cooperatively associated therewith, and a temporary guide base 24. Although as illustrated in FIG. 1, the wellhead subsystem 10 is shown to include a total of three casing hanger bodies. i.e., those identified therein by the reference numerals 12, 14 and 16, it is to be understood that a greater or lesser number of such hanger bodies could equally well be employed in the wellhead subsystem 10 without departing from the essence of the present invention. As is known to those skilld in this art, the hanger bodies 12, 14 and 16, which differ one from another in terms of their respective inner diameters, are each designed to be receivable within the wellhead housing 18, with the latter, in turn, being designed to be received within the wellhead housing 22. Further, in accordance with conventional practice, the wellhead housing 22 of the wellhead subsystem 10 is designed to be suitably secured to a particular one of the other major operating components of the subsea drilling system (not shown), i.e., that commonly referred to as the well control subsystem (not shown). It is also deemed desirable to make mention here of the fact that the contemplated mode of operation of the temporary guide base 24 of the wellhead subsystem 10 requires the placement thereof in juxtaposed relation to the bottom of a body of water, i.e., that in which it is desired to employ the subsea drilling system. In conclusion, the basic function of the wellhead subsystem 10, as has been mentioned previously hereinabove, is that of serving as a pressure vessel to which casing strings are securely sealed while drilling operations are being conducted through the use of the subsea drilling system.

Figure 2:
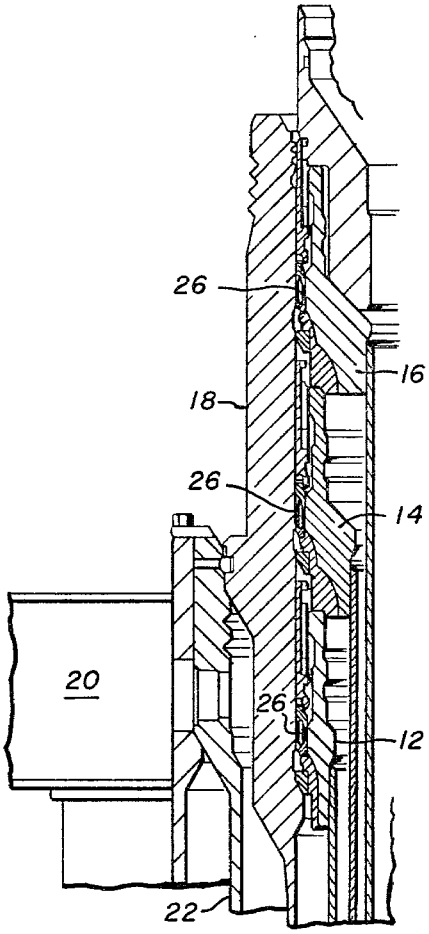
FIG. 2 is a fragmentary vertical section, with parts broken away, of the wellhead subsystem of FIG. 1, illustrating the use therein of a plurality of pack-off seal assemblies constructed in accordance with the present invention.

Proceeding now with the description of the nature of the construction and the mode of operation of the pack-off seal assembly, generally designated in the drawing by reference numeral 26, which forms the subject matter of the present invention, reference will be had for this purpose particularly to FIGS. 2–5 of the drawing. Accordingly, with reference first to FIG. 2, the casing hanger bodies 12, 14 and 16 are each depicted therein positioned in assembled relation to the wellhead housing 18. Moreover, the latter housing 18 is illustrated in the same Figure as being assembled to the wellhead housing 22. Finally, the wellhead housing 22 is shown in FIG. 2 as being cooperatively associated with the permanent guide structure 20. Inasmuch as the manner in which the wellhead housing 18 is assembled to the wellhead housing 22, and the manner in which the latter housing 22 is cooperatively associated with the structure 20 are each effected in a conventional manner, which is well known to those skilled in the art of subsea drilling systems, it is not deemed necessary to include a description thereof herein. In the event, however, that such a description should be desired, it is readily attainable through a reference to the teachings of the prior art.

As exemplified by the showing in FIG. 2, a pack-off seal assembly 26, constructed in accord with the present invention, is preferably suitable interposed, in a manner yet to be described, between the wellhead housing 18 and each of the three casing hanger bodies 12, 14 and 16, i.e., so as to be positioned in sealing relation relative thereto. Inasmuch as all three of the pack-off seal assemblies 26 shown in FIG. 2 are identical in construction, it is deemed adequate for purposes of achieving an understanding of the present invention to simply include herein a detailed dscription of one of these pack-off seal asemblies 26.

Figure 3:
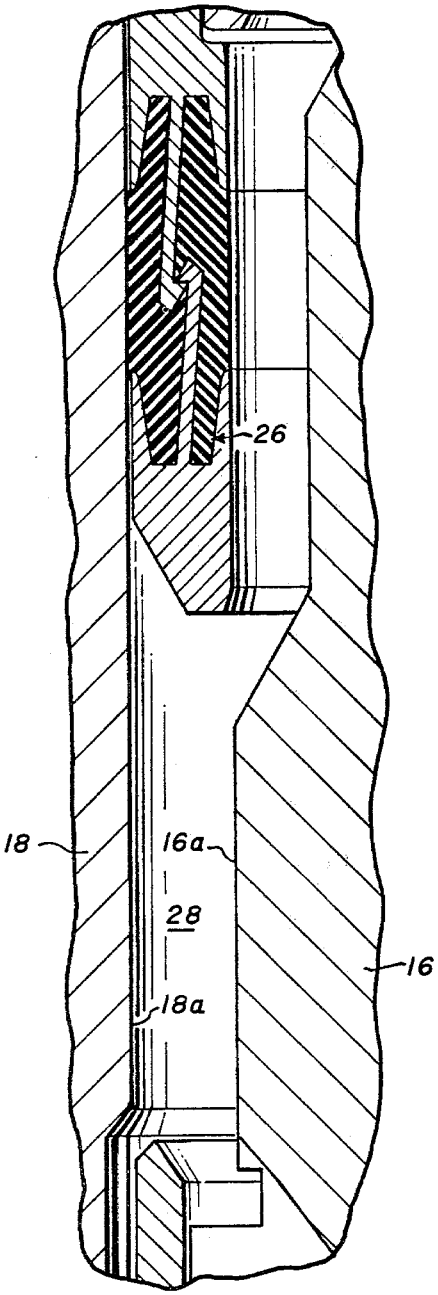
FIG. 3 is a fragmentary vertical section, on an enlarged scale, of a segment of the wellhead system shown in FIG. 2, illustrating a pack-off seal assembly constructed in accordance with the present invention depicted occupying a position corresponding to the non-sealing condition thereof.
Figure 4:
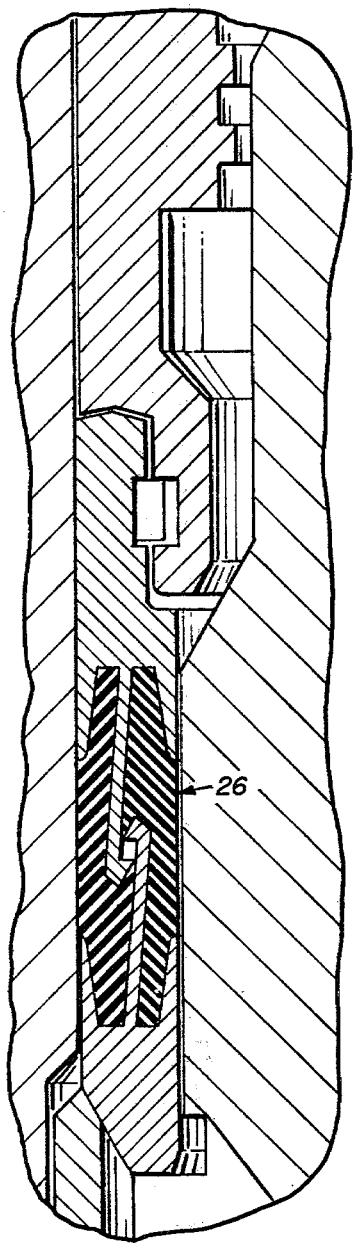
FIG. 4 is a fragmentary vertical section, similar to that of FIG. 3, illustrating a pack-off seal assembly constructed in accordance with the present invention depicted occupying a position corresponding to the sealing, i.e., packed off, condition thereof.

In this context, as best understood with reference to FIGS. 3 and 4 of the drawing, the pack-off seal assembly 26 by way of exemplification is suitably interposed between the inner wall surface **18*a* of the wellhead housing 18 and the outer wall surface 16*a* of the casing hanger body 16. More specifically, the pack-off seal assembly 26 is designed to be inserted in the annular clearance, identified by the reference numeral 28, which necessarily exists between the wellhead housing inner wall surface 18***a* and the casing hanger body outer wall surface 16*a*. Moreover, as will be more fully described hereinafter, the pack-off seal assembly 26 is designed to be movable between a nonenergized, i.e., non-sealing, position relative to the wellhead housing 18 and the casing hanger body 16, the latter position being shown in FIG. 3, and an energized, i.e., pack-off, position relative thereto, the latter position being shown in FIG. 4.

Before proceeding with a description of the manner in which the energization of the pack-off seal assembly 26 is effected, a description will first be had of the nature of the construction of the pack-off seal assembly 26. For this purpose, reference will be made particularly to FIGS. 3–5 of the drawing. It is also worthy of note to mention the fact that, in accord with the best mode embodiment of the invention, the pack-off seal assembly 26 embodies a substantially circular configuration, which dimensionally corresponds to the dimensions of the annular clearance 28 that is formed between the inner wall surface 18*a* of the wellhead housing 18 and the outer wall surface 16*a* of the casing hanger body 16.

Figure 5:
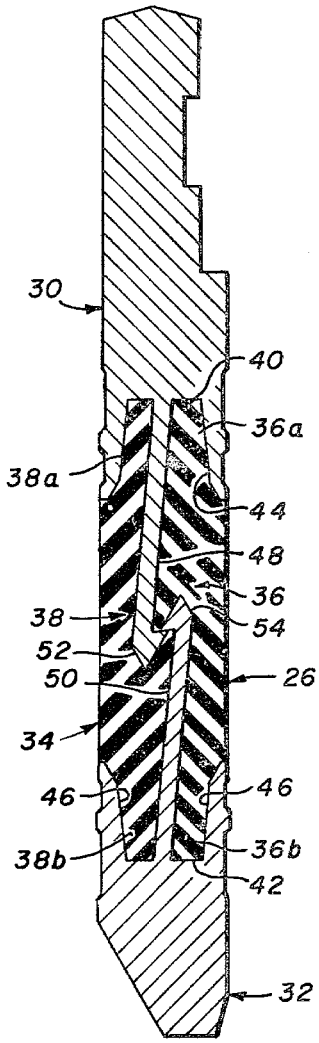
FIG. 5 is a vertical section, on an enlarged scale, of a portion of a pack-off seal assembly constructed in accordance with the present invention.

As seen in FIG. 5, the pack-off seal assembly 26 includes an upper metal seal, generally designated by reference numeral 30; a lower metal seal, generally designated by reference numeral 32; and an elastomeric seal ring, generally designated by reference numeral 34. The seal ring 34, which is preferably formed of rubber, consists of two elastomeric seal elements, i.e., members 36 and 38, respectively. One of the latter seal members, i.e., that identified by reference numeral 36, has a diameter corresponding to the inner diameter of the annular clearance 28, while the other seal member, i.e., that designated by the reference numeral 38, has a diameter corresponding to the outer diameter of the annular clearance 28. In accord with the best mode embodiment of the present invention, each of the seal members 36 and 38 embodies a substantially circular configuration.

Continuing with the description of the pack-off seal assembly 26, the upper metal seal 30 is also circular in configuration. Moreover, for a purpose that will be described more fully hereinafter, the transverse dimension, i.e., that measured along the minor axis, of the upper metal seal 30 is intentionally selected so as to be less than the width of the annular clearance 28. Similarly, the lower metal seal 32 is essentially circular in configuration and measured in the transverse direction, i.e., along the minor axis thereof, is slightly less than the width of the annular clearance 28 for a purpose that will become readily apparent from the discussion that follows hereinafter relative to the matter of the respective modes of operation of the upper and lower metal seals 30 and 32.

With further reference to the upper metal seal 30, the latter preferably has an undercut portion, i.e., groove 40 formed in one end thereof. The configuration, which the groove 40 embodies, is selected to be such that an end of the seal ring 34 is receivable therewithin in supported relation thereof. More specifically, the ends 36*a* and 38*a* of the seal members 36 and 38, respectively, which when taken together comprise the seal ring 34 are themselves suitably configured so as to collectively present a configuration which is complementary to that of the groove 40, as will be best understood with reference to FIG. 5 of the drawing. In like manner, the lower metal seal 32 is provided also with an undercut portion, i.e., groove 42 configured substantially the same as the groove 40 of the upper metal seal 30. Moreover, the configuration of the groove 42 of the lower metal seal 32 is selected to be such that the other ends 36*b* and 38*b* of the seal members 36 and 38, respectively, when placed in juxtaposed relation one to another are receivable in supported relation within the groove 42 in the manner depicted in FIG. 5.

The outer walls of the grooves 40 and 42 are defined by outwardly projecting portions that in configuration resemble pairs of lips 44 and 46, respectively. The latter pairs of lips 44 and 46 are preferably formed integrally with the main body segment of the upper metal seal 30 and the lower metal seal 32, respectively. Moreover, the pairs of lips 44 and 46, in accord with the best mode embodiment of the invention, are constructed from a suitable metal material such as to be deformable laterally when the pack-off seal assembly 26 is placed in a packed off position. More specifically, the spacing present between the individual lips 44 that comprise the pair thereof and that existing between the individual lips 46 is selected so that it is less than the width of the annular clearance 26 whereby the lips 44 and the lips 46 need not undergo deformation in order to render the pack-off seal assembly 26 receivable in the annular clearance 28. With regard to the matter of the deformability of the pairs of lips 44 and 46, reference will be had thereto hereinafter. However, at this point, it is sufficient to merely note that the pair of lips 44 of the upper metal seal 30 function to establish a metal-to-metal seal between the upper metal seal 30 and the inner wall surface 18*a* of the wellhead housing 18 and the outer wall surface 16*a* of the casing hanger body 16 when the pack-off seal assembly 26 is suitably positioned in the annular clearance 28 so as to effect the establishment of the pack-off condition relative thereto. In like fashion, the pair of lips 46 of the lower metal seal 42 are operative in an identical manner to effectuate the establishment of a metal-to-metal seal between the lower metal seal 32 and the wellhead housing 18 and the casing hanger body 16.

Completing the description of the nature of the construction of the pack-off seal assembly 26, the upper metal seal 30 and the lower metal seal 32 are provided with first means and second means, respectively, that are designed to cooperate one with another in a manner that will be more fully described herein subsequently, to insure the retrievability from the annular clearance 28 of particularly the lower metal seal 32 in the event that the need arises to effect the removal of the pack-off seal assembly 26 from the wellhead subsystem 10. In accord with the best mode embodiment of the invention, the afore-referenced first means and second means each comprise an elongated member 48 and 50, respectively. The members 48 and 50 which are formed of metal are suitably joined to the upper metal seal 30 and the lower metal seal 32, respectively, so as to project outwardly therefrom. More specifically, the member 48 is preferably formed integrally with the upper metal 30 so as to extend outwardly therefrom from the base of the groove 40 formed therein. Similarly, the member 50 is preferably formed integrally with the lower metal seal 32 so as to be located centrally of the groove 42, whereby the member 52 is caused to project outwardly from the lower metal seal 32.

As will be best understood with reference to FIG. 5 of the drawing, the elongated members 48 and 50 each terminate in a dog-like portion 52 and 54, respectively, suitably formed integrally therewith at the free end thereof. Each of the dog-like portions 52 and 54 is suitably configured so as to embody a surface, which renders the portions 52 and 54 mutually engageable when the pack-off seal assembly 26 is in its assembled state, i.e., when the seal members 36 and 38 are interposed between the upper metal seal 30 and the lower metal seal 32 in supported relation relative thereto. More specifically, the members 48 and 50 through the interengagement of their dog-like portions 52 and 54, respectively, are operative to establish a lost motion connection between the upper metal seal 30 and the lower metal seal 32 under normal circumstances, and are capable of causing a rigid connection to exist between the upper metal seal 30 and the lower metal seal 32 when there is a need to effect the removal of the pack-off seal assembly 26 from the annular clearance 28. Namely, through the engagement of the mating surfaces of the dog-like portions 52 and 54, it is possible to cause a force to be transmitted through the member 48 to the member 50 and thereby from the upper metal seal 30 to the lower metal seal 32 by virtue of the rigid connection that can be made to exist therebetween. The latter may take the form of a vertical, i.e., pulling force that is applicable to the lower metal seal 32 for purposes of pulling thereon, to effect the removal thereof from the annular clearance 28.

Turning now to a discussion of the method of assembly of the components that comprise the pack-off seal assembly 26, reference will be had particularly to FIG. 5 of the drawing. As depicted therein, both the upper metal seal 30 and the lower metal seal 32 are suitably configured so as to receive in supported relation therebetween the seal ring 34. More specifically, the seal members 36 and 38 that comprise the seal ring 34 are positioned substantially in justaposed relation to each other with the elongated members 48 and 50 extending therebetween and towards each other so that the dog-like portions 52 and 54, respectively, formed at the free end of the latter, are interengaged in the manner shown in FIG. 5. With the seal members 36 and 38 so positioned, the respective ends 36*a*, 36*b* and 38*a*, 38*b* thereof, are insertable into the corresponding grooves 40 and 42 that are provided for this purpose in the upper metal seal 30 and the lower metal seal 32, respectively. Essentially, the seal members 36 and 38 remain positioned relative to the upper and lower metal seals 30 and 32 by virtue of the friction fit that is established between the shaped nature of the grooves 40 and 42 and the complementary configuration relative thereto of the ends 36*a*, 36*b* and 38*a*, 38*b* of the seal members 36 and 38, respectively. In addition, the elastomeric nature of the material from which the seal members 36 and 38 are formed tends to encourage the maintenance of a biasing force between the side walls of the grooves 40 and 42 and the ends 36*a*, 36*b* and 38*a*, 38*b* of the seal members 36 and 38, respectively.

As regards the method of assembling the pack-off seal assembly 26 within the wellhead subsystem 10, any suitable conventional form of mounting means may be employed for this purpose. However, in accord with the best mode embodiment of the invention, the pack-off seal assembly 26 is preferably mountable on a casing hanger body for movement therewith as well as relative thereto. To this end, by way of exemplification, the pack-off seal assembly 26 is preferably supported relative to the casing hanger body 16 in the manner that is to be found taught by the patentees Hynes, et al. in U.S. Pat. No. 3,797,864. Inasmuch as the latter patent contains a complete detailed description of the manner of mounting a prior art form of pack-off seal assembly to a casing hanger body, and inasmuch as this prior art form of mounting means as taught in the afore-referenced Hynes, et al. patent is applicable for use in effecting the mounting of the pack-off seal assembly 26, constructed in accord with the present invention, to the casing hanger body 16, it is not deemed necessary to include a description thereof herein, but rather it is deemed sufficient to simply incorporate herein by reference the teachings in this regard of the Hynes, et al. patent.

Similarly, any suitable conventional method may be employed for purposes of accomplishing the energization of the pack-off seal assembly 26, i.e., to cause the latter to move from a non-sealing relation relative to the wellhead housing 18 and the casing hanger body 16 to a position corresponding to the pack-off condition thereof relative thereto. In accordance with the teachings of the prior art, there are basically two such methods that have been utilized for purposes of effecting the energization of prior art forms of pack-off seal assemblies. Either of these latter two methods may be utilized for purposes of effectuating the energization of the pack-off seal assembly 26, constructed in accordance with the present invention. Inasmuch as both of the latter methods are well known to those skilled in this art, it is not deemed necessary to describe either or both of them at length herein.

Simply by way of summary, however, the aforesaid two methods differ one from another insofar as concerns the manner in which the energizing force is transmitted to the pack-off seal assembly. Thus, in accord with one of the aforesaid methods, the energizing force is in the form of a torque, while in accord with the other method a hydraulic force is utilized. The effect of the employment of either form of energizing force is to cause the pack-off seal assembly 26 to move from an energized position relative to the annular clearance 28 to an energized position relative thereto, with the annular clearance 28 being defined in accord with the illustration of FIGS. 2–4 of the drawing of the instant application as being the clearance space which exists between the inner wall surface 18*a* of the wellhead housing 18 and the outer wall surface 16*a* of the casing hanger body 16. Additionally, if it is deemed desirable, reference may also be had to the afore-referenced Hynes, et al. patent for a prior art teaching of the manner in which an energizing force is applied to a pack-off seal assembly to accomplish the energization of the latter.

Upon the energization of the pack-off seal assembly 26, the latter occupies a position corresponding to the pack-off condition thereof. The term "pack-off condition" as employed herein is intended to mean that condition wherein the major components of the pack-off seal assembly 26 bear the following relationships to the wellhead housing 18 and the casing hanger body 16, with which the former, in accord with the illustrations of FIGS. 2–4 of the drawing, are depicted as being associated. Namely, when the pack-off seal assembly 26 is in the pack-off condition, a metal-to-metal seal between the upper metal seal 30 and the wellhead housing 18 and the casing hanger body 16 is established as a consequence of the engagement of the pair of lips 44 of the upper metal seal 30 with the inner wall surface 18*a* of the wellhead housing 18 and with the outer wall surface 16*a* of the casing hanger body 16. In a like manner, a metal-to-metal seal is created between the lower metal seal 32 and the wellhead housing 18 and the casing hanger body 16 by virtue of the engagement of the pair of lips 46 of the lower metal seal 32 with the outer wall surface 18*a* of the wellhead housing 18 and with the inner wall surface 16*a* of the casing hanger body 16. Finally, in the course of effecting the energization of the pack-off seal assembly 26 for purposes of establishing the pack-off condition thereof, relative movement occurs between the upper metal seal 30 and the lower metal seal 32 such that the elastomeric seal members 36 and 38 are subjected to deformation whereby the respective outer surfaces of the seal members 36 and 38 are caused to bear against the outer wall surface 18*a* of the wellhead housing 18 and the inner wall surface 16*a* of the casing hanger body 16 intermediate the points whereat the aforesaid outer wall surface 18*a* and the inner wall surface 16*a* are engaged by the pairs of lips 44 and 46. In summary, when the pack-off seal assembly 26 is in the packed off condition, three separate sealing relationships are established; namely, the metal-to-metal seal between the upper metal seal 30 and the wellhead housing 18 and the casing hanger body 16, the metal-to-metal seal between the lower metal seal 32 and the wellhead housing 18 and the casing hanger body 16, and the elastomeric-to-metal seal between the seal ring 34 and the wellhead housing 18 and the casing hangar body 16. In accord with the best mode embodiment of the invention, the seal that is established when the pack-off seal assembly 26 is in its packed off condition is equivalent to the application of a pressure of essentially 15,000 psi to the contacting surfaces. However, notwithstanding the existence of a pressure of such magnitude, a characteristic of the pack-off seal assembly 26 is that the seal members 36 and 38 exhibit virtually no tendency either to deteriorate or to undergo what is referred to by those skilled in the art as cold flow. One reason for this lack of cold flow of the seal members 36 and 38 is believed to reside in the fact that the lips 44 and 46 function to contain the seal members 36 and 38 in a captive state therebetween. From the above, it should thus be apparent that permanency of seal quality is attainable with a pack-off seal assembly 26 constructed in accord with the present invention.

Another desirable characteristic of the pack-off seal assembly 26 of the present invention is that the aforereferenced sealing pressure of 15,000 psi is capable of being attained through the application thereto of an energizing force of a considerable lesser magnitude than that which has heretofore been required for purposes of effecting the energization of prior art forms of pack-off seal assemblies. By way of exemplification in this regard, it is known that it takes the application of an energizing force on the order of 20,000 ft.-lbs. to establish a sealing pressure of 10,000 psi with a pack-off seal assembly constructed in accordance with the teachings of the Hynes, et al. patent to which reference has previously been had herein. On the other hand, it has been found that a force of 10,000 ft.-lbs. is sufficient to establish a sealing pressure of 15,000 psi when employing a pack-off seal assembly such as the pack-off seal assembly 26, constructed in accordance with the present invention. The attainment of such a reduction in the magnitude of the actuating force is particularly significant when recognition is given to the fact that this actuating force must, in some manner, be transmitted a substantial distance between the surface of the body of water where the force is generated and the bottom of the body of water whereat the pack-off seal assembly 26 is emplaced. The inability to transmit the requisite actuating force to the location whereat the pack-off seal assembly is utilized has the potential of comprising a limitation as to the distance over which it is possible to conduct drilling operations with heretofore known forms of subsea drilling systems. Now with the availability of the pack-off seal assembly 26 constructed in accord with the present invention, and the characteristic possessed thereby wherein a sealing pressure of 15,000 psi is achievable through the application thereto of an energizing force of 10,000 ft.-lbs., the fear of drilling operations being limited by virtue of the inability to transmit forces of relatively large magnitude through the required distances has been significantly reduced.

Related to the matter of the magnitude of the force required to effect the energization of the pack-off seal assembly 26 is another favorable feature which characterizes the latter assembly 26. Namely, it has been found that the deformation of the pairs of lips 44 and 46 can be controlled to a considerable extent. More specifically, the lips 44 and 46 with which the upper metal seal 30 and the lower metal seal 32, respectively, are provided do not, unlike prior art forms of pack-off seal assemblies, undergo a gradual deformation. Rather, each increment of deformation experienced thereby is more distinctly demarcated. This distinction between the gradual deformation which characterizes, for example, the pack-off seal assembly taught by the aforementioned Hynes, et al. patentees, and the more demarcated deformation of the lips 44 and 46 of the pack-off seal assembly 26 is at least in part a reflection of the fact that the latter assembly makes use of a pair of seal members 36 and 38, whereas in the former prior art form of assembly, the elastomeric seal ring comprises a single member. In addition, modifications in the nature of the configurations of the lips 44 and 46 have been effected as compared, for instance, to prior art forms thereof. Accordingly, in the case of the prior art, the bearing force relationships that exist between the lips thereof and the single ring seal are considerably different from the bearing force relationships which exist between the lips 44 and 46 and the seal members 36 and 38. By virtue of the existence of this difference in their respective bearing force relationships, and through the proper selection of the metal material from which the lips 44 and 46 are constructed, it is possible to control within a predetermined range of force values the point at which deformation of the lips 44 and 46 occurs. This is desirable, for instance, from the standpoint of insuring that the proper sealing relationships are made to exist between the pack-off seal assembly 26 and the wellhead housing 18 and the casing hanger body 16. Insofar as concerns the matter of selecting the proper material from which the lips 44 and 46 are formed, consideration must be given to a number of variables, including the dimensions of the lips 44 and 46, the extent to which it is desired to have the lips 44 and 46 deform, the sealing pressure that it is desired to have applied to contacting surfaces, etc.

The pack-off seal assembly 26, constructed in accord with the present invention, embodies yet another feature, which serves to advantageously characterize the latter. Reference is had here to the first means and the second means with which the upper metal seal 30 and the lower metal seal 32, respectively, are provided. As described hereinabove previously, the aforesaid first and second means are operative to effect the establishment of a rigid connection between the upper metal seal 30 and the lower metal seal 32. Through the establishment of this rigid connection, it is possible to apply a pulling force to the lower metal seal 32 to effect the retrievability thereof from within the annular clearance 28, in the event there arises a need to accomplish the removal of the pack-off seal assembly 26 from the wellhead subsystem 10. In accord with the best mode embodiment of the invention, the first means comprises an elongaged metallic member 48 having a dog-like portion 52 formed at the free end thereof, while a second means comprises an elongated metallic member 50 having a dog-like portion 54 formed at the free end thereof. The dog-like portions 52 and 54 are designed to be interlockable. Finally, the mode of operation of the first and second means is such that under normal circumstances, a lost motion connection is established thereby whereby the existence of the first and second means does not interfere in any manner with the accomplishment of the functions that the pack-off seal assembly 26 is designed to perform.

Thus, in accordance with the present invention, there has been provided a new and improved form of seal assembly operable for effecting a seal between a pair of spaced surfaces. Moreover, the subject seal assembly of the present invention is particularly suitable for use in the wellhead portion of a subsea drilling system. In addition, in accord with the present invention, a seal assembly is provided that is operable to effect the packing off of the annular clearance between an underwater wellhead housing and the respective casing hangers, which are landed in the housing. Further, the seal assembly of the present invention is characterized in the fact that it is capable of providing maximum seal integrity over extended periods. Additionally, in accordance with the present invention, a seal assembly is provided which is energizable in response to the application thereto of an energizing force of a significantly lesser magnitude than that required heretofore by the prior art forms of seal assemblies that have been employed for similar purposes. Also, the seal assembly of the present invention embodies first and second means that are cooperatively associated one with another so as to be operative to establish a lost motion connection therebetween when the subject seal device is in a state of energization, and so as to be operable to form a rigid connection therebetween when a need arises to effect the removal of the subject seal device from between a wellhead housing and a casing hanger. Furthermore, in accord with the present invention, a seal assembly is provided, which is relatively inexpensive to provide and easy to employ, while yet being compatible for use in subsea drilling systems of known construction.

While only one embodiment of our invention has been shown, it will be appreciated that modifications thereof, some of which have been alluded to hereinabove, may still be readily made thereto by those skilled in the art. We, therefore, intend, by the appended claims, to cover the modifications alluded to herein as well as all other modifications, which fall within the true spirit and scope of our invention.

We claim:

1. In a drilling system including at least a first body member and a second body member cooperatively associated with the first body member so as to define a clearance space therebetween, the improvement of a pack-off seal assembly supported in the drilling system for movement between a non-sealing position and a sealing position relative to the clearance space and operable when occupying the sealing position thereof to effect a packing off of the clearance space, said pack-off seal assembly comprising:

a. a first metal seal means having a first pair of lip portions projecting outwardly therefrom, said first pair of lip portions being operable to establish a metal-to-metal seal between the first and second body members when said pack-off seal assembly occupies the sealing position thereof;

b. a second metal seal means having a second pair of lip portions projecting outwardly therefrom, said second pair of lip portions being operable to establish a metal-to-metal seal between the first and second body members when said pack-off seal assembly occupies the sealing position thereof;

c. an elastomeric seal ring supported in interposed relation between said first metal seal means and said second metal seal means, said elastomeric seal ring means being operable to establish an elastomeric-to-metal seal between the first and second body members when said pack-off seal assembly occupies the sealing position thereof; and d. retrieving means cooperatively associated with said first metal seal means and said second metal seal means, said retrieving means including a first elongated member projecting outwardly from said first metal seal means so as to extend in substantially parallel relation to said first pair of lip portions, said first elongated member having the free end thereof extending in a first direction into said elastomeric seal ring so as to be encircled thereby, said retrieving means further including a second elongated member projecting outwardly from said second metal seal means so as to extend in substantially parallel relation to said second pair of lip portions, said second elongated member having the free end thereof extending in a second direction into said elastomeric seal ring so as to be encircled thereby, said free end of said first elongated member being spaced from said free end of said second elongated member so as to establish a lost motion connection between said first and second elongated members and thereby also between said first metal seal means and said second metal seal means when said pack-off seal assembly is moved in a first direction relative to the clearance space defined by the first and second body members, said free end of said first elongated member being interengaged with said free end of said second elongated member so as to establish a rigid connection between said first and second elongated members and thereby also between said first metal seal means and said second metal seal means when said pack-off seal assembly is moved in a second direction relative to the clearance space defined by the first and second body members thereby to insure the retrievability from the clearance space of said second metal seal means.

2. In a drilling system as set forth in claim 1 wherein said first elongated member is metallic and is formed integrally with said first metal seal means so as to be located centrally of said first pair of lip portions.

3. In a drilling system as set forth in claim 2 wherein said first elongated metallic member has a first dog-like portion formed at said free end thereof.

4. In a drilling system as set forth in claim 3 wherein said second elongated member is metallic and is formed integrally with said second metal seal means so as to be located centrally of said second pair of lip portions.

5. In a drilling system as set forth in claim 4 wherein said second elongated metallic member has a second dog-like portion formed at said free end thereof, said second dog-like portion being spaced apart from said first dog-like portion to effect the establishment of the lost motion connection between said first metal seal means and said second metal seal means, said second dog-like portion interlocking with said first dog-like portion to effect the establishment of the rigid connection between said first metal seal means and said second metal seal means.

6. In a drilling system as set forth in claim 1 wherein said elastomeric seal ring means comprises a pair of sealing members positioned in juxtaposed relation to each other.

7. In a drilling system as set forth in claim 6 wherein said pair of sealing members are of differing diameters, and wherein each of said pair of sealing members is of an elastomeric material.

8. In a drilling system as set forth in claim 1 wherein said first pair of lip portions and said second pair of lip portions both undergo a rapid deformation as said pack-off seal assembly is moved into the sealing position thereof in the course of effecting said metal-to-metal seal between said first pair of lip portions and the first and second body members and said metal-to-metal seal between said second pair of lip portions and the first and second body members.

* * * * *